United States Patent [19]

Joseph et al.

[11] Patent Number: 4,874,043

[45] Date of Patent: Oct. 17, 1989

[54] METHOD OF PRODUCING VISCOUS OIL FROM SUBTERRANEAN FORMATIONS

[75] Inventors: Earl M. Joseph; Robert J. Pritchard; Arshad H. Sufi, all of Tulsa, Okla.

[73] Assignee: Amoco Corporation, Chicago, Ill.

[21] Appl. No.: 246,223

[22] Filed: Sep. 19, 1988

[51] Int. Cl.[4] ..... E21B 43/24

[52] U.S. Cl. ..... 166/272; 166/273

[58] Field of Search ..... 166/271–274, 166/303, 50

[56] References Cited

U.S. PATENT DOCUMENTS

| | | | |
|---|---|---|---|
| 3,375,870 | 4/1968 | Satter et al. | 166/271 X |
| 3,439,742 | 4/1969 | Durie | 166/272 |
| 3,477,510 | 11/1969 | Spillette | 166/272 |
| 3,537,526 | 11/1970 | Offeringa | 166/272 X |
| 3,847,219 | 11/1974 | Wang et al. | 166/272 X |
| 3,994,340 | 11/1976 | Anderson et al. | 166/50 X |
| 4,249,604 | 2/1981 | Frazier | 166/272 X |
| 4,303,126 | 12/1981 | Blevins | 166/272 X |
| 4,465,137 | 8/1984 | Sustek, Jr. | 166/272 |
| 4,466,485 | 8/1984 | Shu | 166/272 |
| 4,696,345 | 9/1987 | Hsueh | 166/50 X |

*Primary Examiner*—George A. Suchfield

*Attorney, Agent, or Firm*—L. Wayne White; Fred E. Hook

[57] ABSTRACT

Viscous oil is recovered from a subterranean formation by (a) establishing flow communication between an injection well and a production well in a flow path along the lower portion of a formation pay zone containing the viscous oil, (b) heating the flow path and adjacent portions of the pay zone with hot water or low quality steam, (c) injecting alternating slugs of hot water and steam through the injection well and into the pay zone overlying the heated flow path to cause the oil to liquify and drain into the heated flow path and to be displaced toward the production well, (d) displacing substantially all of the oil in the heated path by hot water, and (e) recovering produced fluids through the production well. The flow path is conveniently created by placing a horizontal well from the vertical injection well into the pay zone.

5 Claims, 5 Drawing Sheets

FIG.1a STEAM INJECTION

FIG.1b HOT WATER

METHOD OF PRODUCING VISCOUS OIL FROM SUBTERRANEAN FORMATIONS

BACKGROUND OF THE INVENTION

1. Field of the Invention

This invention pertains to a method of producing viscous oil from a formation pay zone penetrated by an injection well and a production well. The method utilizes alternating slugs of steam and hot water through the injection well into the pay zone overlying a heated flow path between the injection and production wells.

2. Description of the Prior Art

In the annotated manual of "Oil and Gas Terms," 7th Edition, by Howard R. Williams (1987) the term "Tertiary Recovery" is identified as: Enhanced recovery methods for the production of crude oil or natural gas. Enhanced recovery of crude oil requires a means for displacing oil from the reservoir rock, modifying the properties of the fluids in the reservoir and/or the reservoir rock to cause movement of crude oil in an efficient manner, and providing the energy and drive mechanism to force its flow to a production well. Chemicals or energy are injected as required for displacement and for the control of flow rate and flow pattern in the reservoir, and a fluid drive is provided to force the oil toward a production well. Basic methods include thermal methods wherein heat energy is added to the formation.

Such thermal methods have been investigated extensively as a means for recovering viscous oil from subterranean formations. The viscosity of the oil makes it essentially immobile under formation conditions, and therefore it is essentially unrecoverable by primary and secondary recovery methods. The oil typically has an API gravity of less than about 20° and a viscosity of up to about 10,000 centipoise (cps) or more. The primary classes of oils meeting this standard are referred to in the industry as "heavy oils," "tar sands" and "bitumen." For example: heavy oil has a viscosity of about 100 to 10,000 cps and an API gravity of 10 to 20 whereas the tar sand oil has a viscosity of 10,000 cps or more and an API gravity of 10 or less. There are several major formations in North America (and elsewhere) that contain petroleum (oil) which has such physical properties and is too viscous to be recovered by ordinary production methods. The viscous oil reserves in Utah, California and Alberta, Canada, is reasonably estimated in the billions of barrels. See, for example, U.S. Pat. No. 4,696,345 at column 1, lines 8–14. The economic incentive to recover such reserves is huge.

Many thermal methods have been suggested as a means to recover viscous oil, and some of them have even been successful in producing oil. Some methods have proposed using slotted liners positioned in the formations as conduits for hot fluids. Others have applied heat to the formation by use of steam or hot water or by underground combustion. Many of these methods were unsuccessful because of the difficulty of forming and maintaining fluid communication between the injection well and the production well. One of the techniques used to address this communication problem has been to drill a horizontal well placed from the injection well into the pay zone and, in some instances, to the production well. Another technique utilizes the horizontal well approach and adds piping that let steam and/or hot water circulate through the piping to warm the adjacent formation. This later technique is illustrated, for example, in U.S. Pat. No. 3,994,340 and U.S. Pat. No. 4,696,345 which are incorporated by reference.

Steam flooding is another thermal method that has been used with varying degrees of success. Steam is considerably lighter than the oil and water present in the formation and thus, because of gravity segregation, it tends to rise to the top of the formation when vertical communication exists. Consequently, the injected steam channels through the top of the formation to the producing well overriding a major portion of the formation and contacting only a small fraction of the formation oil. Once steam override has begun, continued injection of steam into the formation will accomplish very little additional oil recovery. This behavior results in an inefficient oil recovery and low vertical sweep efficiency. U.S. Pat. No. 4,607,695 attempts to address this problem by injecting a mixture of steam, a noncondensable gas, and a special class of surfactants into the formation to create a "stable foam" which acts as a diverting agent to decrease the permeability of one zone (i.e., channel) and to divert steam into other portions of the formation. The present invention also addresses sweep efficiency of a steam flood, but with an entirely different approach.

Another steam flooding technique is described in U.S. Pat. No. 4,597,443. There, a predetermined amount of steam, not greater than 1.0 pore volume, is injected into the formation through an injection well at an injection rate of 4 to 7 barrels of steam (cold water equivalent) per day per acre-foot of formation and produced fluids, including oil, are recovered through a production well. The steam temperature is within the range of 500° to 700° F. and it has a quality of 50 to 90 percent. The high steam injection rate was said to be essential in the process to minimize heat loss to surrounding underground strata. The process also requires shutting in the injection well periodically to let the injected steam condense in the formation and let the resulting heat dissipate into the formation to reduce the viscosity of the oil. Then, a predetermined amount of hot water or low quality steam , not greater than 1.0 pore volume, is injected into the formation with no interruption of production during the steps. The process in U.S. Pat. No. 4,597,443 is "related" to the present invention in that both utilize steam and hot water in the process. The disclosure of U.S. Pat. No. 4,597,443 is incorporated by reference.

The processes in U.S. Pat. No. 4,535,845 and U.S. Pat. No. 4,037,658 are also "related" to the present invention in that both use an injection well and a producing well in a steam flood and the present method can use horizontal wells described in U.S. Pat. No. 4,535,845 and U.S. Pat. No. 4,037,658 to create the heated path between the injection and production wells. The disclosures of U.S. Pat. No. 4,535,845 and U.S. Pat. No. 4,037,658 are accordingly incorporated by reference.

Other steam flooding and thermal recovery techniques are disclosed in the following nonexhaustive list of U.S. patents: U.S. Pat. Nos. 4,515,215; 4,489,783; 4,466,485; 4,465,137; 4,460,044; 4,450,911; 4,392,530; 4,390,067; 4,303,126; 4,020,901; 3,994,340; 3,847,219; 3,682,244; 3,572,437, and references cited therein.

SUMMARY OF THE INVENTION

A new method for producing viscous oil from subterranean formations has now been discovered. The new method comprises the steps of:

(a) establishing fluid flow communication (a flow channel) between the injection well and the production well in a flow path (channel) along lower portions of a formation pay zone containing said viscous oil;

(b) heating the flow path and adjacent portions the pay zone with hot water or low quality steam;

(c) injecting alternating slugs of hot water and steam through the injection well and into the pay zone overlying the heated flow path to cause the viscous oil to liquify and drain into the heated flow path and to be displaced toward the production well by hot water;

(d) displacing substantially all of the oil in the heated path by hot water; and (e) recovering produced fluids through the production well.

The new method enhances sweep efficiency and utilization of heat units in the injected fluids and it also enhances the recovery of viscous oil.

BRIEF DESCRIPTION OF THE DRAWINGS

FIG. 1(*a*) shows the steam injection cycle in which steam enters the formation, rises and causes the heated, liquified oil to drain into the heated "zone" or "flow path. " FIG. 1(*b*) shows the alternating hot water injection cycle in which hot water is used to displace the mobile oil through the heated path toward the production well where the produced fluids (including oil) are withdrawn.

DETAILED DESCRIPTION OF THE INVENTION

Figure 1:
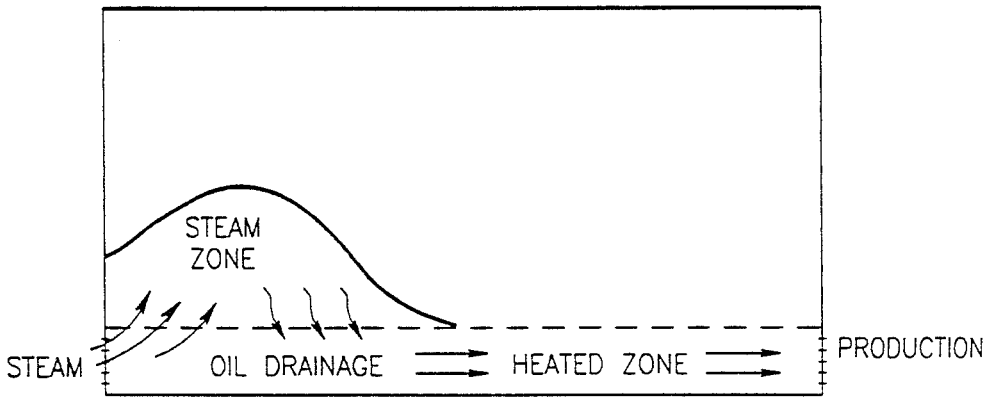
FIGS. 1(*a*) and 1(*b*) graphically illustrate the theory of the present process.
Figure 1:
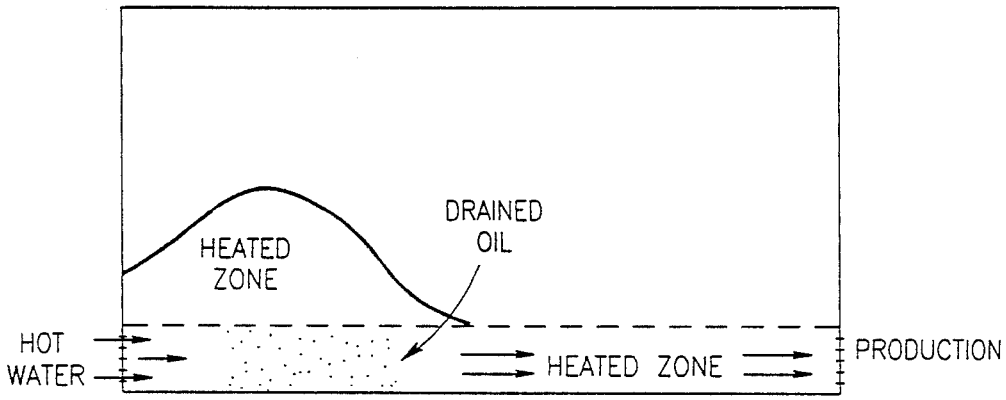

The novel process can be used to enhance recovery from any subterranean formation that contains oil that is too viscous to remove by conventional recovery techniques. As noted above such oil is typically referred to as heavy oil, tar sand or bitumen. The formation pay zones containing viscous oil are commonly (sandwiched) located between two relatively impermeable rock formations or "capped" with such an impermeable formation with an underlying formation that is water permeable. In the first instance, a lateral or horizontal well placed from the injection well or drilled separately will be the preferred means of establishing fluid flow communications and a flow path between an injection well and a spaced apart production well which penetrates the formation pay zone. The lateral or horizontal well can also be used when the pay zone has an adjacent underlying water permeable formation, such as most of the tar sand formations. In this later instance, however, a horizontal well is not required to establish fluid communication between the injection and production wells but it may still be preferred to better control the heated flow path.

It will be understood that the practice of this invention requires two wells, but may involve others. The injection and production wells may be part of a "spot pattern" which has been designed to maximize production from the field. Thus, the injection well may be used to provide steam/hot water to stimulate the flow of oil which is received in a plurality of producer wells, and vice versa.

Fluid communication between the injection and production wells leads to a flow path that can be heated. If the communication link is a horizontal well, cased or uncased, hot water and/or steam on other heated fluid can be circulated through the wells to heat the adjacent formation. If the horizontal well contains the appropriate piping, the heating medium can be circulated within the well to heat the formation; e.g., the HASDrive technique in U.S. Pat. Nos. 4,696,345 and 3,994,340. If the pay zone has an underlying water permeable zone, then hot water and/or low quality steam can be used to establish the fluid communication between wells and the heated flow path by injection of same through the injection well and recovering the condensed/cooled fluids through the production well. The heated medium is injected into and through the flow path for a time sufficient to raise the temperature of the adjacent pay zone and viscous oil to a temperature at least sufficient to liquify the viscous oil and make it mobile in the heated zone. Typically, the temperature of the heated medium is from about 300° to about 500° F. The injection of such heated fluids normally proceeds from about three months to twelve months. And, the temperature of the heat flow path in formation is normally raised to about 150° to about 300° F. during this step of the present invention.

Once fluid communication is established and the flow path heated, alternating slugs of hot water and steam are injected through the injection well into the lower pay zone. Hot water is injected to establish injectivity and flow paths into the pay zone and to displace mobile oil in the heated flow path. The following slug of steam tends to follow such flow paths into the pay zone, but the injection rate usually falls quickly, at which point hot water is started again until injectivity is reestablished, then steam is injected, etc. The injection rate or length of time that steam can be injected normally increases with each hot water/steam cycle until steam can be injected at the maximum or optimum rate prescribed by the operator for a particular formation. This, of course, is the ultimate goal because the high injectability rate of steam indicates the viscous oil has been swept from the formation.

EXPERIMENTAL

The Steam-Water Alternating Process (SWAP) is shown in FIGS. 1*a* and 1*b*. For a flow path near the base of the formation, injected steam will rise as shown in FIG. 1*a*. The flow path itself can either be a naturally occurring higher water saturation zone or a region heated by circulating steam in an unperforated horizontal well from the injector to the producer. As steam, rises, heated oil will drain into the flow path, limiting the flow capacity. The injection is then converted to hot water which can flow more easily in the reservoir because of the lower specific volume of water compared to steam. The water then displaces the oil drained into the flow path and re-establishes the zones mobility. The steam-hot water cycles are repeated until a maximum injection rate of steam injection is obtained.

This process was tested using a scaled physical steamflood model. The model and associated flow equipment is described in CIM paper No. 88-39-61 titled "Injectivity Enhancement in Tar Sands - A Physical Model Study," which is incorporated herein by reference. This paper was presented at the 39th annual technical meeting of the Petroleum Society of CIM in Calgary, June 12–16, 1988. The equipment was modified to include a horizontal well. This was a ⅛th inch stainless steel tube placed in the model from the injector to the producer. Using control valves, flow could be initially directed to this tube to heat the region surrounding it by heat conduction. Once a heated zone had been established, steam or hot water could then be directed to the vertical injector.

Figure 2:
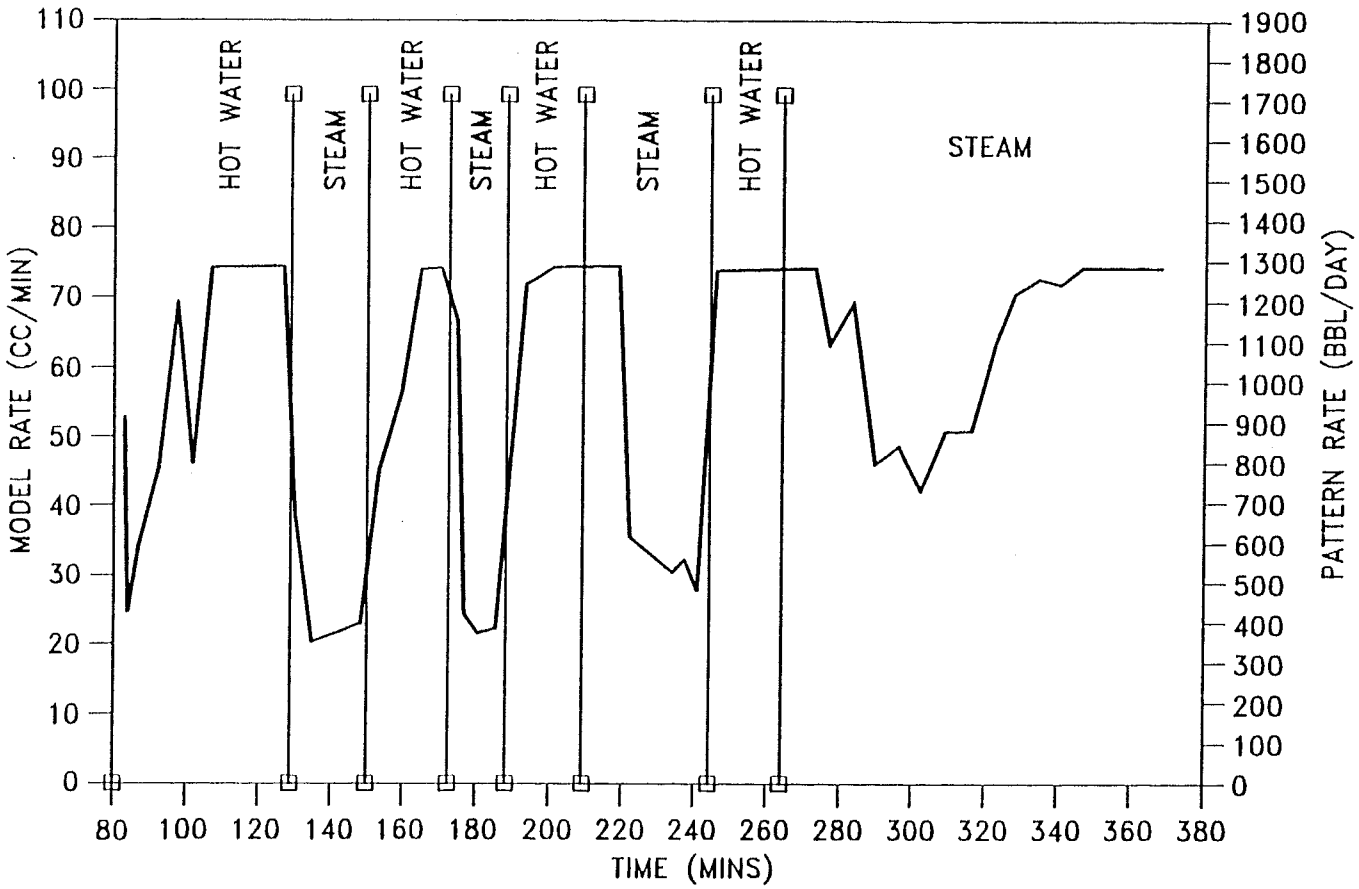
FIGS. 2 through 5 production curves based on experiments further detailed below.
Figure 3:
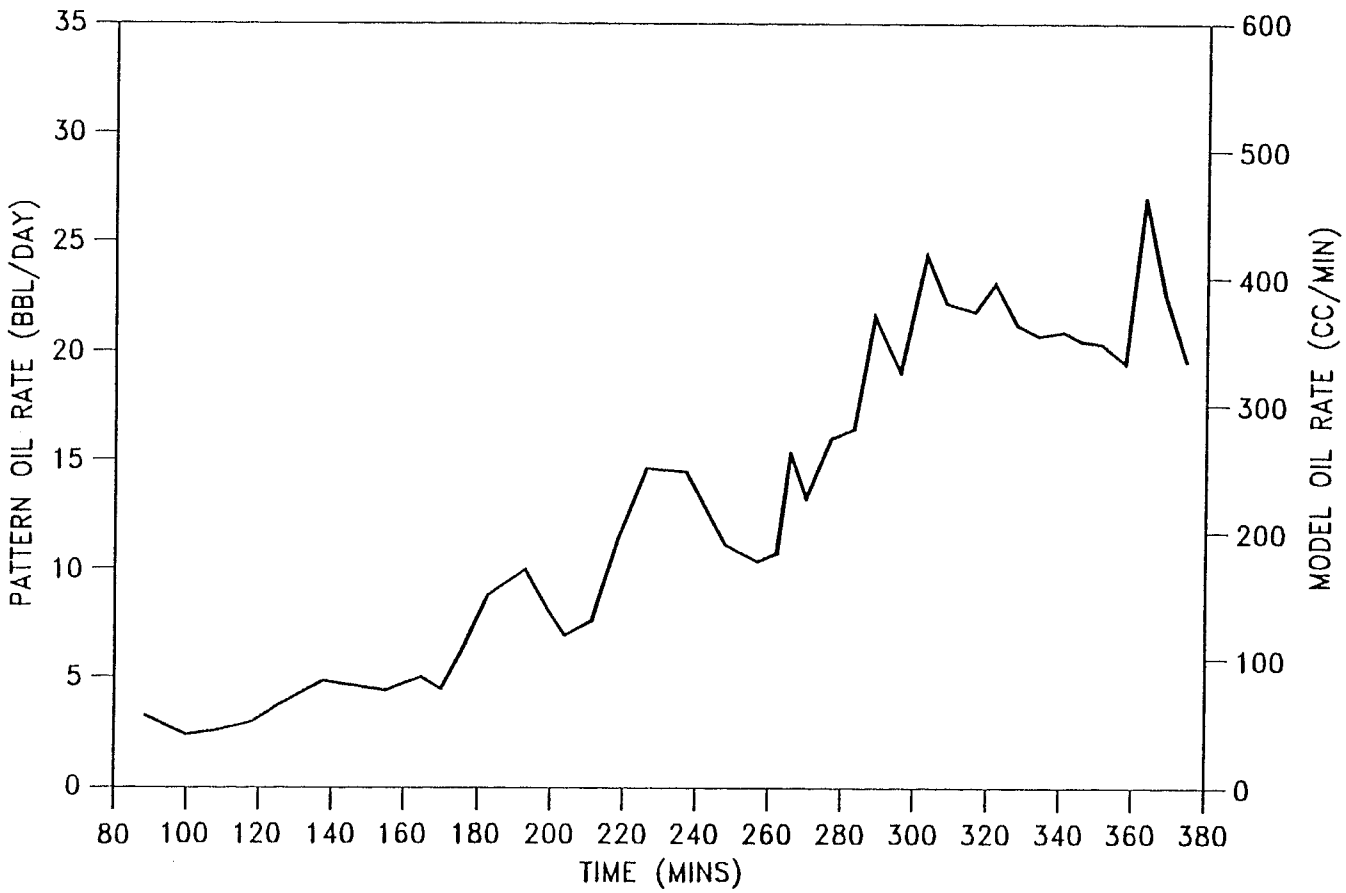

The first run consisted of flowing steam through the horizontal well for 80 minutes after which steam injection into the vertical well was attempted. This resulted in a negligible mass injection rate into the model. In run 2, steam was again circulated in the horizontal well for 80 minutes after which the SWAP process was attempted. FIG. 2 shows the cold water equivalent (CWE) injection rates into the model. The scale on the left corresponds to the rates observed in the laboratory. The scale on the right is the field equivalent scaled rates in barrels per day. As can be seen, during periods of hot water injection, the injection rate built up to the maximum injection rate of the pumps. During the steam injection cycles, the rate fell. The minimum rate during each steam subsequent steam cycle however, increased until the maximum rate was achieved during steam injection. FIG. 3 shows the oil production during this period. It shows the oil production increasing steadily to a maximum at about 300 minutes.

Figure 4:
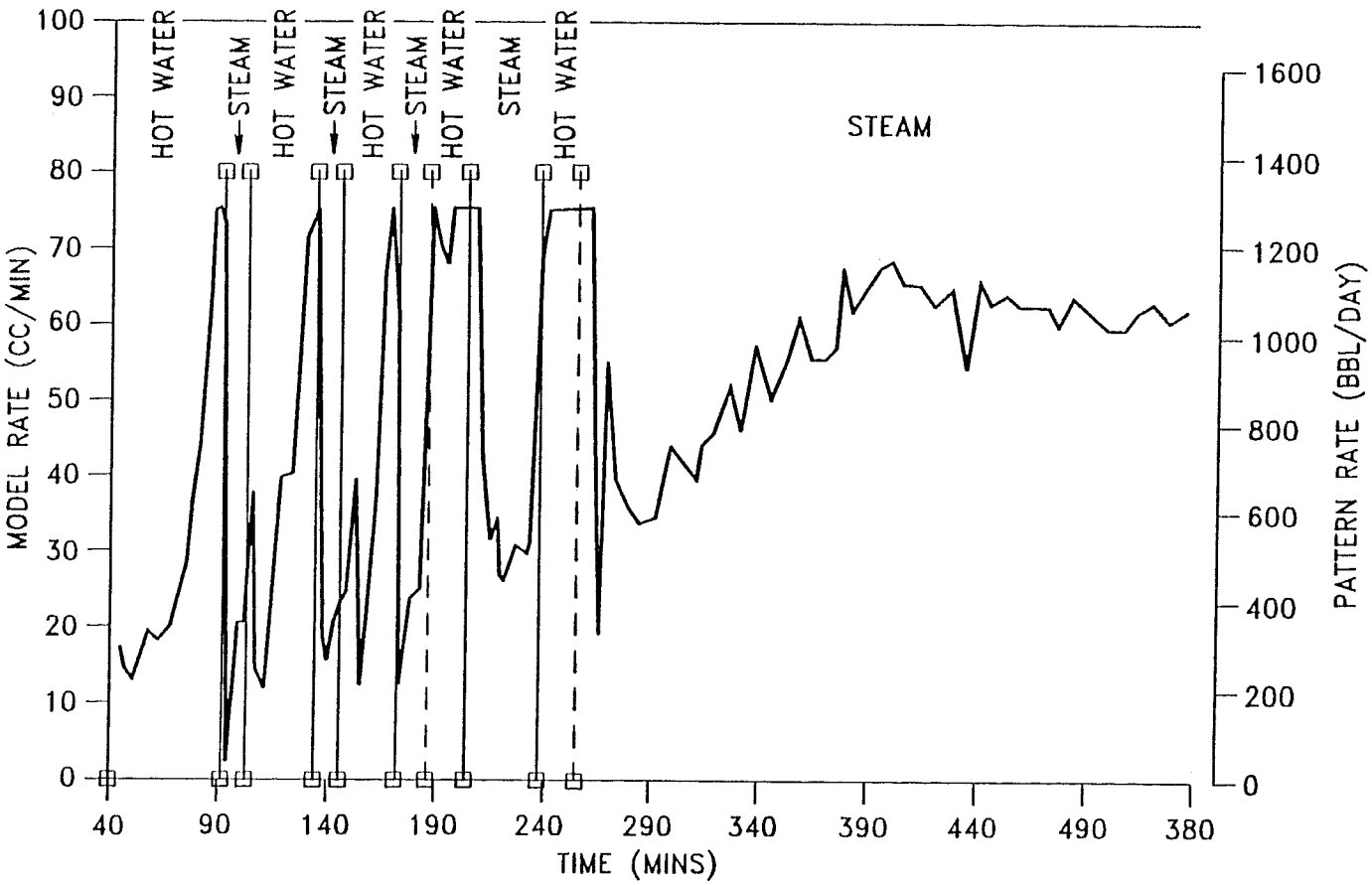
Figure 5:
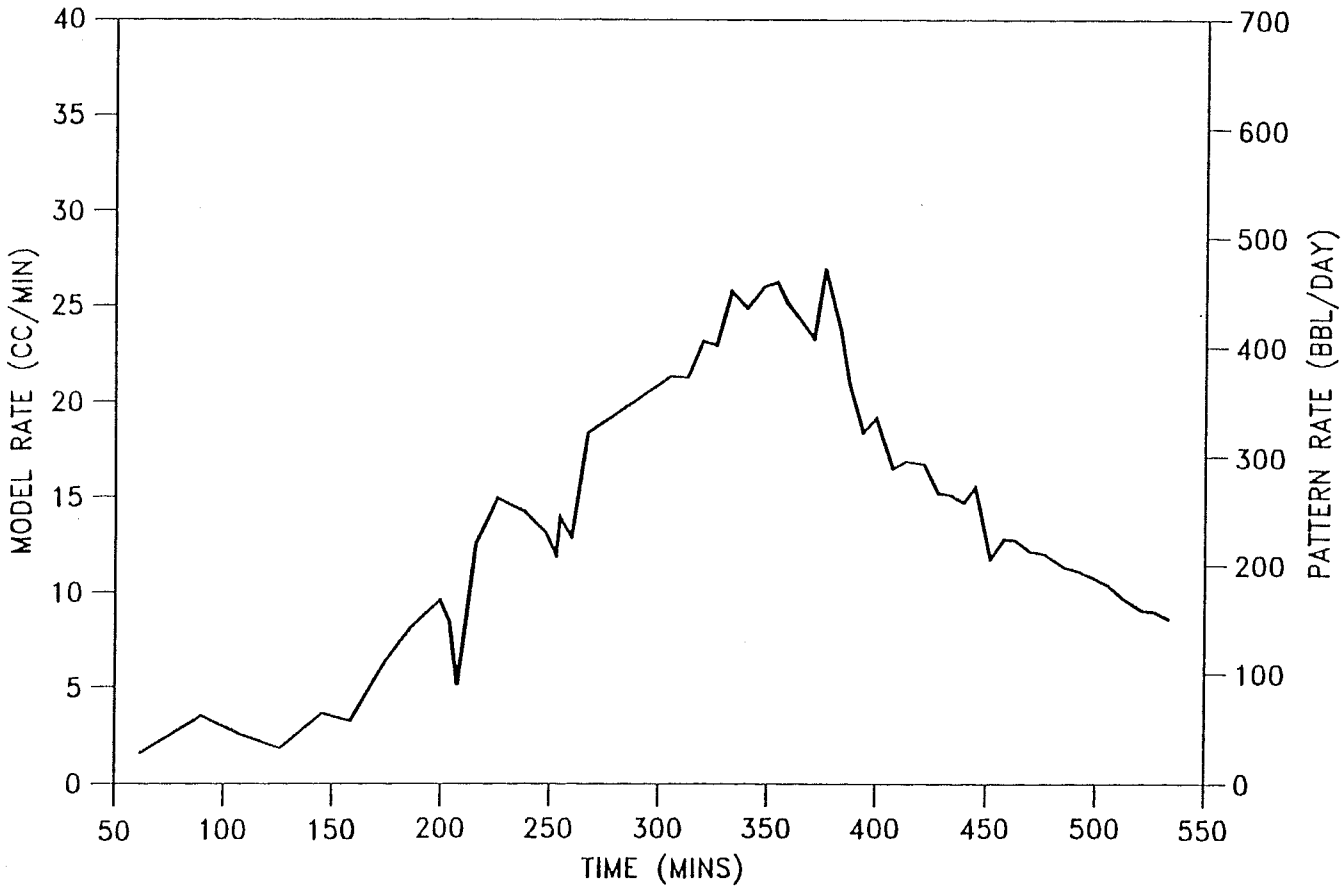

In run 3, the initial steam circulation time was reduced to 40 minutes after which the SWAP process was initiated. FIG. 4 shows the injection rates during the steam and hot water injection cycles. The CWE injection rate increased during hot water injection to the maximum pump output rate. During steam injection, the rates were lower. In this run, the final steam injection rate was lower then the maximum rate. This was a result of the shorter heating time of 40 minutes at the start of the test. The shorter time resulted in a less mobile flow path during the experiment. The oil production from this test is shown in FIG. 5. It shows the oil reaching a maximum and then following an established decline till the end of the test. In this test, 76.4% of the oil-in-place was recovered.

What is claimed is:

1. A method for producing viscous oil from a subterranean formation penetrated by an injection well and a spaced apart production well, said method comprising the steps of:

(a) establishing fluid flow communication between the injection well and the production well in a flow path along lower portions of a formation pay zone containing said viscous oil;

(b) heating the flow path and adjacent portions of the pay zone by injecting hot water or low quality steam into and through the flow path for a time sufficient to raise the temperature of the adjacent pay zone and viscous oil to a temperature at least sufficient to liquify the viscous oil and make it mobile in the heated zone and displaceable by hot water;

(c) injecting alternating slugs of hot water and steam through the injection well and into the pay zone overlying the heated flow path to cause the viscous oil in the pay zone to liquify and drain into the heated flow path and to be displaced toward the production well by hot water;

(d) subsequent to step (c), displacing substantially all of the oil in the heated path by hot water; and (e) recovering produced fluids through the production well.

2. The method defined by claim 1 wherein said flow path is established, at least in part, by a lateral or horizontal well placed into the pay zone.

3. The method defined by claim 2 wherein said flow path is established, at least in part, by a lateral or horizontal well placed from the vertical injection well into the pay zone.

4. The method defined by claim 1 wherein hot water is used to heat the flow path and adjacent portions of the pay zone in step (b).

5. A method for producing viscous oil from a subterranean formation penetrated by an injection well and a spaced apart production well, said method comprising the steps of:

(a) establishing fluid flow communication between the injection well and the production well in a flow path along lower portions of a formation pay zone containing said viscous oil;

(b) heating the flow path and adjacent portions of the pay zone by injecting hot water or low quality steam into and through the flow path for a time sufficient to raise the temperature of the adjacent pay zone and viscous oil to a temperature at least sufficient to liquify the viscous oil and make it mobile in the heated zone and displaceable by hot water;

(c) injecting alternating slugs of hot water and steam through the injection well and into the pay zone overlying the heated flow path to cause the viscous oil in the pay zone to liquify and drain into the heated flow path and to be displaced toward the productions well by hot water; in this step (c), hot water is injected to establish injectivity and flow channels into the pay zone, and steam is then injected until the injection rate begins to fall, at which point hot water is injected again until.injectivity us reestablished, then a following slug of steam is injected until the injection rate begins to fall, and this alternating cycle of hot water/steam injection is continued until the maximum or optimum rate of steam injection prescribed by the operator for the particular formation being treated is achieved;

(d) subsequent to step (c), displacing substantially all of the oil in the heated path by hot water; and (e) recovering produced fluids through the production well.

* * * * *